United States Patent [19]

Watson et al.

[11] 4,334,611

[45] Jun. 15, 1982

[54] ENVELOPE TYPE CARTON

[75] Inventors: William H. Watson; Chauncey Young, both of St. Louis, Mo.

[73] Assignee: Container Corporation of America, Chicago, Ill.

[21] Appl. No.: 218,504

[22] Filed: Dec. 22, 1980

[51] Int. Cl.[3] ..... B65D 85/02

[52] U.S. Cl. ..... 206/303; 206/472; 206/474; 206/482; 206/492; 229/40

[58] Field of Search ..... 206/492, 482, 483, 472, 206/473, 474, 475, 303; 229/87 R, 87 A, 40

[56] References Cited

U.S. PATENT DOCUMENTS

| | | | |
|---|---|---|---|
| 855,216 | 5/1907 | Andersen | 206/482 |
| 936,777 | 10/1909 | Herzfelder | 206/482 |
| 1,690,883 | 11/1928 | Ziegler | 229/87 A |
| 1,720,679 | 7/1929 | Karn | 229/87 A |
| 1,871,426 | 8/1932 | Schmitt | 206/475 |
| 1,907,227 | 5/1933 | Weil | 206/303 |
| 2,147,470 | 2/1939 | Tate | 206/482 |
| 2,284,987 | 6/1942 | Ramel et al. | 206/303 |
| 2,320,018 | 5/1943 | Ullman | 229/40 |
| 3,298,513 | 1/1967 | Krooss et al. | 229/40 |

*Primary Examiner*—Stephen P. Garbe

*Attorney, Agent, or Firm*—Richard W. Carpenter; Davis Chin

[57] ABSTRACT

A one-piece, self-locking envelope type carton having a plurality of compartments.

2 Claims, 5 Drawing Figures

ENVELOPE TYPE CARTON

SUMMARY OF THE INVENTION

This invention relates to an envelope type folding carton for enclosing a plurality of packaged articles such as piston rings.

It is an object of the invention to provide a one-piece, self-locking folder type of carton formed of foldable sheet material such as paperboard or the like.

A more specific object of the invention is the provision of a carton having a base panel and a plurality of other panels which are each adapted to retain a packaged article and to be folded so as to overlie the base panel and be held in position by an interlocking arrangement.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 2:
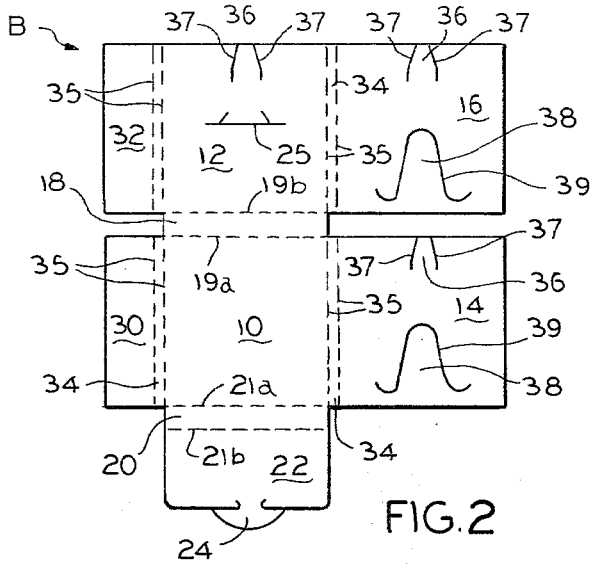
FIG. 2 is a plan view of a blank of sheet material from which the carton illustrated at FIG. 1 may be formed.
Figure 5:
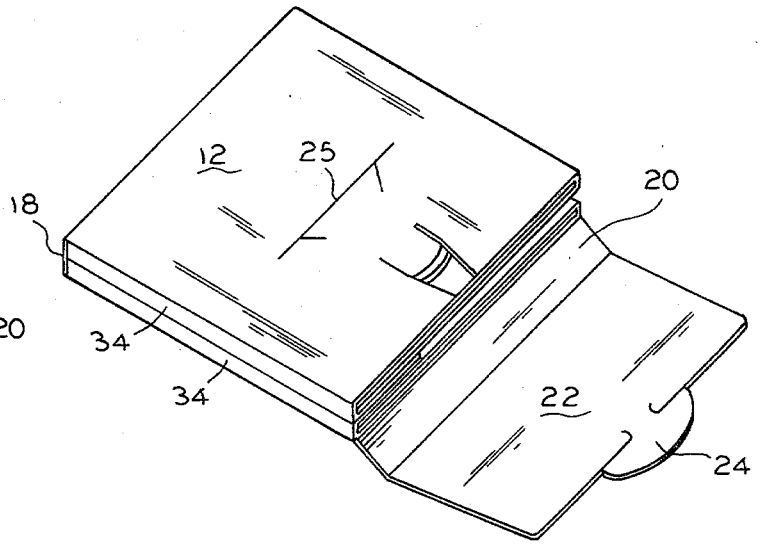
FIG. 5 is a perspective view of the carton which has been completely erected but not yet fully closed.
Figure 1:
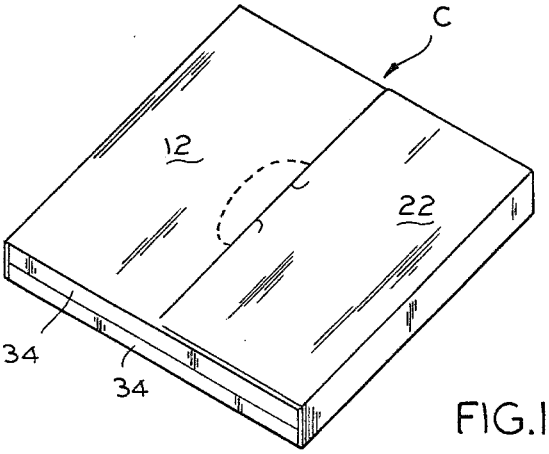
FIG. 1 is a perspective view of an erected and closed carton embodying features of the invention.

Referring now to the drawings for a better understanding of the invention, it will be seen that the carton indicated generally at C in FIGS. 1 and 5 and which is adapted to hold a plurality of articles A, such as piston rings, may be formed from a unitary blank B of foldable sheet material, such as paperboard, illustrated in FIG. 2.

The carton includes four primary panels of substantially the same shape and dimension. These are main or bottom panel 10, top panel 12, first intermediate panel 14, and second intermediate panel 16. Panels 10 and 12 are joined to each other by a rear end panel 18 which is foldably joined along opposite side edges on fold lines 19*a* and 19*b* to panels 10 and 12, respectively.

The carton also includes first and second side flaps 30 and 32. First and second intermediate panels 14 and 16 and first and second flaps 30 and 32 are foldably joined to opposite sides of bottom and top panels 10 and 12, respectively, by means of side panels 34, each of which are foldably joined at its opposite side edges along fold lines 35 to the respective panels which are interconnected by the side panels.

The carton also includes a front end panel 20 which is foldably joined along one edge on fold line 21*a* to the front edge of bottom panel 10 and which is foldably joined along another edge on fold line 21*b* to a closure panel 22. It will be noted that closure panel 22 has projecting therefrom a locking tongue or tab 24 adapted to being interlockingly received within a slit 25 presented in top panel 12. Panels 12, 14 and 16 are provided with retaining tabs 36 which are located at the edge of the panels and which are each defined by a pair of cut lines 37.

Figure 3:
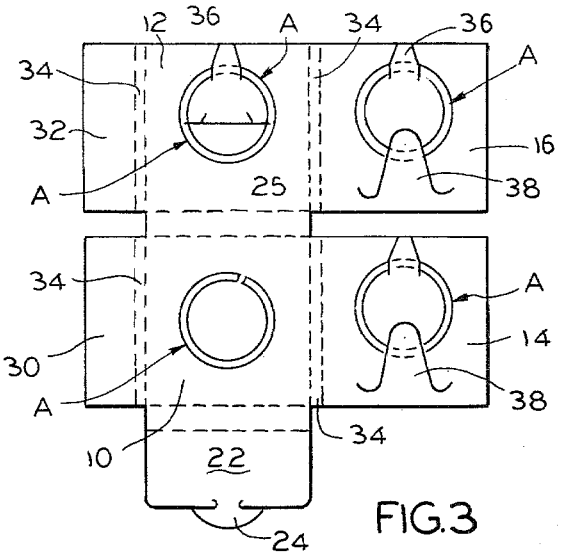
FIG. 3 is a view similar to FIG. 1, but illustrating the manner in which the packaged articles are attached to the various panels of the carton.

Panels 14 and 16 are also provided with additional retaining tabs 38 which are defined by inverted generally v-shaped cut lines 39. The package is designed to enclose a plurality of relatively small articles, such as piston rings, which may be placed on the various panels as shown in FIG. 3, with the articles on panels 12, 14 and 16 engaged by the retaining tabs 36 and 38.

Figure 4:
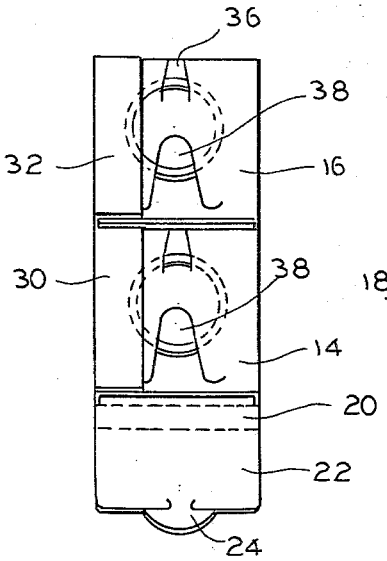
FIG. 4 is a plan view of the carton of FIG. 3 shown after certain of the panels have been folded to closed position.

In order to close the carton, the intermediate panels 14 and 16 are folded 180° so as to overlie bottom and top panels 10 and 12. Side flaps 30 and 32 are then folded over 180° to overlie marginal portions of intermediate panels 14 and 16, respectively. At this point, the carton is in the condition illustrated in FIG. 4. Top panel 12, together with second intermediate panel 16 and second side flap 32 are then folded 180° to overlie bottom panel 10, first intermediate panel 14 and first side flap 30. The carton is then in the condition illustrated in FIG. 5.

At this point, the closure panel 22 and front end wall 20 are folded up so the closure panel overlies the top panel and the lock tap 24 is inserted within the slit 25 of top panel 12 in interlocking engagement and yet to maintain the package in closed condition.

We claim:

1. A multi-layered, self-locking, envelope type carton, formed of a unitary blank of paperboard, comprising:

(a) a pair of top and bottom retaining panels;

(b) a pair of first and second intermediate retaining panels, of substantially the same dimensions as said top and bottom panels, interposed therebetween and defining a plurality of compartments for holding packaged articles;

(c) said compartments being closed at the front and rear by front and rear end panels extending between said top and bottom panels;

(d) said compartments being closed at the sides by side panels extending between said intermediate panels and said top and bottom panels;

(e) a closure panel foldably joined to said front end panel and having interlocking engagement with said top panel;

(f) first retaining means formed in the edges of said top, first intermediate and second intermediate retaining panels and adapted to serve as protective dividers between the packaged articles; and (g) second retaining tabs of a generally inverted V-shape formed in said first and second intermediate retaining panels on edges opposite to said first retaining tabs and adapted to separate the packaged articles.

2. A unitary blank of foldable sheet material, such as paperboard, which is cut and scored to form a self-locking, envelope type carton, comprising:

(a) a bottom panel;

(b) a top panel having a lock tab receiving slit therein;

(c) a rear panel foldably joined at opposite edges to said top and bottom panels;

(d) a pair of first and second intermediate panels disposed adjacent corresponding sides of said bottom and top panels;

(e) a pair of first and second side flaps disposed adjacent other side edges of said bottom and top panels opposite said first and second intermediate panels;

(f) said intermediate panels and said side flaps being foldably connected to said bottom and top panels by relatively narrow side panels;

(g) a front panel foldably joined to an edge of said bottom panel;

(h) a closure panel foldably joined to an edge of said front panel and having a lock tab projecting therefrom;

(i) first retaining tabs formed in the edges of said top, first intermediate and second intermediate panels; and (j) second retaining tabs of a generally inverted V-shape formed in said first and second intermediate panels on edges opposite to said first retaining tabs.

* * * * *